US012644353B2

(12) United States Patent
Liew et al.

(10) Patent No.: US 12,644,353 B2
(45) Date of Patent: Jun. 2, 2026

(54) RADIAL SEALING SURFACE SYSTEM AND METHOD

(71) Applicant: Vetco Gray, LLC, Houston, TX (US)

(72) Inventors: Joseph Shu Yian Liew, Singapore (SG); Mark James Bridges, Inverbervie (GB); Michael Shaw, Aberdeen (GB); Huy Hoang Nguyen, Ho Chi Minh City (VN); Duy Cong Nguyen, Ho Chi Minh City (VN); Durai Balaji Kamalasekaran, Bangalore (IN); David Malcolm Finlayson, Aberdeen (GB); An Thi Khoi Bui, Ho Chi Minh City (VN)

(73) Assignee: Vetco Gray, LLC, Houston, TX (US)

( * ) Notice: Subject to any disclaimer, the term of this patent is extended or adjusted under 35 U.S.C. 154(b) by 0 days.

(21) Appl. No.: 18/645,158

(22) Filed: Apr. 24, 2024

(65) Prior Publication Data

US 2025/0334021 A1 Oct. 30, 2025

(51) Int. Cl.
*E21B 33/12* (2006.01)

(52) U.S. Cl.
CPC ..... *E21B 33/1212* (2013.01)

(58) Field of Classification Search
CPC ..... E21B 33/00–076; E21B 33/1212
See application file for complete search history.

(56) References Cited

U.S. PATENT DOCUMENTS

| | | | |
|---|---|---|---|
| 4,709,933 A | 12/1987 | Adamek et al. | |
| 4,913,464 A | 4/1990 | Taylor et al. | |
| 5,103,915 A | 4/1992 | Sweeney et al. | |
| 6,007,111 A | 12/1999 | Wafer | |
| 6,722,426 B2 | 4/2004 | Sweeney et al. | |
| 7,314,085 B2 | 1/2008 | Hopper et al. | |
| 9,045,961 B2 | 6/2015 | Melancon et al. | |
| 9,103,457 B2 | 8/2015 | Holliday | |
| 9,382,771 B2 | 7/2016 | Hart et al. | |
| 10,151,167 B2 | 12/2018 | Cain et al. | |
| 10,927,637 B2 | 2/2021 | Cheng et al. | |
| 11,890,709 B2 | 2/2024 | Vorley | |
| 2003/0000694 A1* | 1/2003 | Sweeney | E21B 33/02 166/115 |

(Continued)

FOREIGN PATENT DOCUMENTS

| | | |
|---|---|---|
| AU | 2013230153 A1 | 8/2014 |
| GB | 2608252 A | 12/2022 |
| WO | 2013134250 A1 | 9/2013 |

OTHER PUBLICATIONS

"Collet Connectors, Connectors for BOP stacks", Cameron, A Schlumberger Company, 2017, 4 pages.

(Continued)

*Primary Examiner* — Kristyn A Hall
(74) *Attorney, Agent, or Firm* — Hogan Lovells US LLP

(57) ABSTRACT

A metallic seal includes a first leg having a first sealing profile and a second leg having a second sealing profile. The metallic seal also includes an inner bore including a first inner diameter and a second inner diameter. The metallic seal further includes a first radial contact point, along the first sealing profile and a second radial contact point, along the second sealing profile, wherein the second radial contact point is a larger outer diameter of the seal than the first radial contact point.

20 Claims, 5 Drawing Sheets

(56) References Cited

U.S. PATENT DOCUMENTS

| | | | | |
|---|---|---|---|---|
| 2005/0173122 | A1 | 8/2005 | Hopper et al. | |
| 2009/0322030 | A1* | 12/2009 | Pallini, Jr. ..... | E21B 17/04 277/336 |
| 2013/0175055 | A1 | 7/2013 | Hart et al. | |

OTHER PUBLICATIONS

Yufang Li et al., "Metal sealing mechanism and experimental study of the subsea wellhead connector", Journal of the Brazilian Society of Mechanical Sciences and Engineering, Dec. 6, 2019, vol. 42, Article No. 26, https://link.springer.com/article/10.1007/s40430-019-2112-1, 8 pages.

International Search Report and Written Opinion issued in PCT Application No. PCT/US2025/024195, dated Jul. 22, 2025.

* cited by examiner

RADIAL SEALING SURFACE SYSTEM AND METHOD

BACKGROUND

1. Field of the Disclosure

The present disclosure relates to wellbore operations. Specifically, the present disclosure relates to systems and methods for sealing systems used in wellbore operations.

2. Description of Related Art

Wellbore operations, such as oil and gas exploration and production, injection, and/or the like, may be conducted in a variety of environments, such as subsea or surface environments, where components are installed on a rig or sea floor. Certain components, either within the wellbore, at the wellbore, or outside of the wellbore, may be coupled together with one or more sealing systems used to maintain pressure barriers at various locations associated with the wellbore. Sealing systems may include metallic or polymer seals, among others, that are positioned between different component parts to prevent leakage at various interfaces. Various sealing systems may also include sealing surfaces that are machined or otherwise prepared for specific connection and interface purposes. Shapes of these sealing surfaces may affect how components are joined together, how easy parts are to manufacture, and/or how components react to internal and/or external forces that may be present in different environments.

SUMMARY

Applicant recognized the problems noted above herein and conceived and developed embodiments of systems and methods, according to the present disclosure, for sealing systems.

In an embodiment, a wellbore system includes a first component having a first sealing interface at a first diameter and a second component having a second sealing interface at a second diameter, the second diameter being larger than the first diameter. The system also includes a seal arranged between the first component and the second component. The seal includes a first leg having a first sealing profile configured to engage the first sealing interface and a second leg having a second sealing profile configured to engage the second sealing interface. The seal further includes a stepped inner diameter including a first inner diameter associated with the first leg, a second inner diameter associated with the second leg, and a step between the first inner diameter and the second inner diameter. The seal also includes an asymmetric cross-section corresponding to different radial contact points between the first leg and the first component and the second leg and the second component.

In an embodiment, a metallic seal includes a rib, a first leg, coupled to the rib, having a first sealing profile, and a second leg, coupled to the rib, having a second sealing profile. The metallic seal also includes an inner bore including a first inner diameter extending for a first length, a second inner diameter extending for a second length, and a step between the first inner diameter and the second inner diameter. The metallic seal further includes a first radial contact point, aligned with the first inner diameter, at a first radial distance from a rib end. The metallic seal also includes a second radial contact point, aligned with the second inner diameter, at a second radial distance from the rib end, wherein the first radial distance is greater than the second radial distance.

In another embodiment, a metallic seal includes a seal body, a first leg having a first sealing profile, and a second leg having a second sealing profile, the first and second legs separated by at least a portion of the seal body. The metallic seal further includes an inner bore including a first inner diameter and a second inner diameter. The metallic seal also includes a first radial contact point, along the first sealing profile and a second radial contact point, along the second sealing profile, wherein the second radial contact point is at a larger outer diameter of the seal than the first radial contact point.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

Figure 1A:
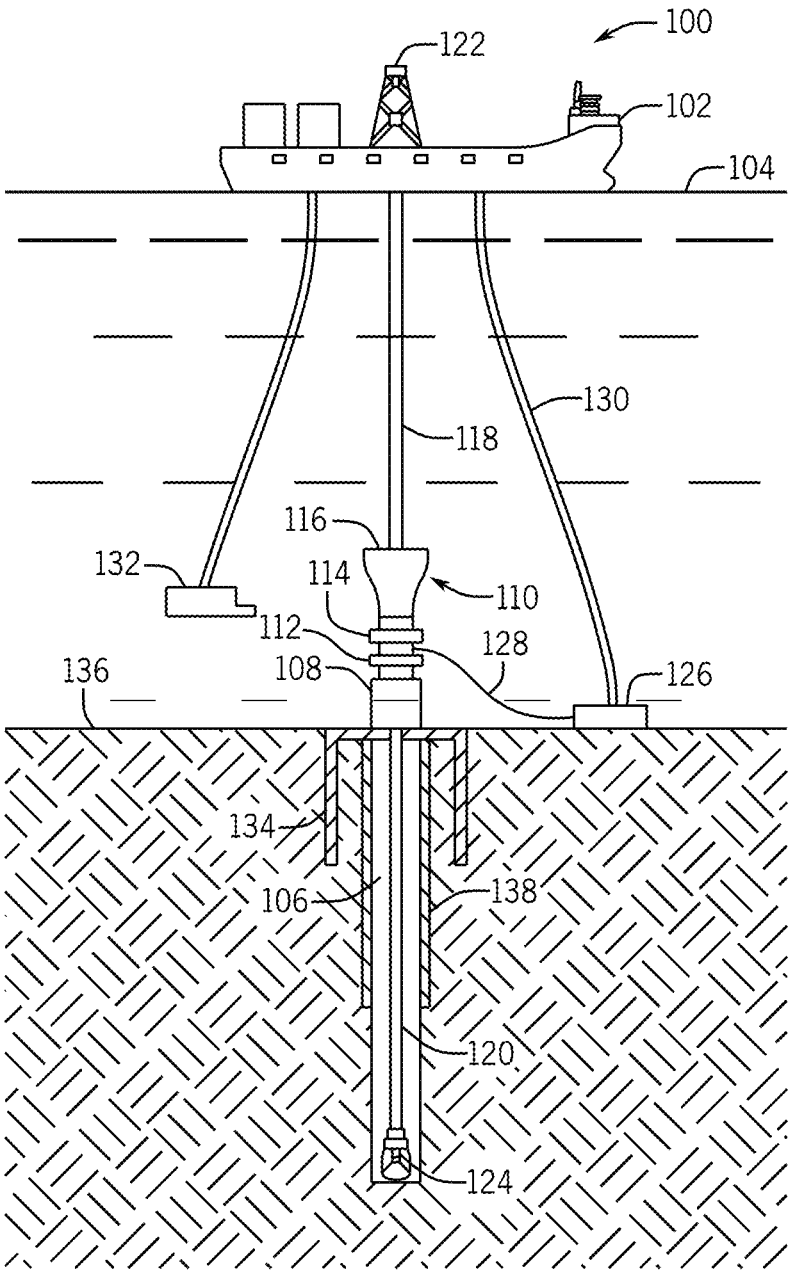
FIG. 1A is a schematic side view of an embodiment of an offshore drilling operation, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. It should be further appreciated that terms such as approximately or substantially may indicate +/−10 percent.

Embodiments of the present disclosure are directed toward systems and methods for forming seals between different components, such as components that may be used in oil and gas exploration and production, among various other industries. In at least one embodiment, metal-to-metal seals are used to form pressure barriers between different component interfaces, where the component interfaces may be "mismatched" with respect to different diameters associated with sealing surfaces. Accordingly, embodiments may be directed toward sealing systems that include asymmetric cross-section gaskets, among other features. Systems and methods may be deployed with asymmetric cross-sections to fit gaskets associated with mismatched seal groove sizes. Furthermore, systems and methods may also incorporate one or more stepped bores on an inner profile to counteract imbalances stemming from the asymmetric cross-section. Accordingly, embodiments may provide a simple, cost-effective solution that may be used to retrofit or repackage existing wellbore components to facilitate interfacing with a variety of different connectors.

In at least one embodiment, a seal may be used between two or more wellbore components, such as various tubulars, hangers, and/or the like. The seal may be arranged at an interface between components that facilities coupling of various other tools to the wellbore. Tools may have different inner diameters (e.g., bores) and as a result, coupling interfaces may vary from one tool to the next. Because of this difference, it may be challenging to develop and then install sealing systems because different components of the system may be subjected to different pressures and/or forces.

As one example, if an upper seal portion seals along a first diameter and a lower seal portion seals along a second, larger diameter, the upper seal portion may be thinner than the lower seal portion, which may cause the lower seal portion to be less flexible and/or provide reduced sealing effectiveness when exposed to the same pressure. Systems and methods of the present disclosure may address and overcome these problems by providing a seal with a stepped and/or variable inner bore that may be used to adjust thicknesses of the various seal portions, thereby providing a selectable thickness for a variety of different operations, which may be selected based on expected pressure conditions, expected setting pressures, and/or the like.

Embodiments of the present disclosure may address and overcome problems with existing systems. For example, existing wellheads may include a standard dimension, such as a standard inner diameter, that cannot accommodate updated components without significant modification or redesign, which may be undesirable or unfeasible for systems that are already in place, such as a subsea wellhead or a remote location. Accordingly, as new components are developed, legacy systems may become outdated. As one example, it may be desirable to add new components to wellheads, which may include fasteners such as internal thread profiles, to facilitate coupling to one or more trees or other components. The threads may need sufficient space for engagement and the like, and as a result, the bore size may be increased to accommodate for the additional space. As one non-limiting example, certain configurations may include a bore that is sealed with a metal gasket that, using current configurations, is approximately thirteen and five-eights (13-⅝) inches. However, the modification and/or addition of new tools may lead to a larger bore for one or more components, such as fourteen (14) inches. Traditional gasket/seal configurations may not work with this arrangement, either causing a redesign of the design, removal of existing systems, and/or other costly intervention techniques. Systems and methods of the present disclosure address this problem by providing, at least in part, an asymmetric cross-section along with a variable inner seal diameter.

FIG. 1A is a side schematic view of an embodiment of a subsea drilling operation 100. It should be appreciated that one or more features have been removed for clarity with the present discussion and that removal or inclusion of certain features is not intended to be limiting, but provided by way of example only. Furthermore, while the illustrated embodiment describes a subsea drilling operation, it should be appreciated that one or more similar processes may be utilized for surface applications and, in various embodiments, similar arrangements or substantially similar arrangements described herein may also be used in surface applications. Additionally, in at least one example, the subsea operation may be referred to as a shallow-water system. Furthermore, a drilling application is provided as a non-limiting example and various systems or methods could also be used in other applications, including recovery, inspection, data collection, and/or the like. The drilling operation includes a vessel 102 floating on a sea surface 104 substantially above a wellbore 106. As noted, the vessel 102 is for illustrative purposes only and systems and methods may further be illustrated with other structures, such as floating/fixed platforms, and the like. A wellbore housing 108 sits at the top of the wellbore 106 and is connected to a blowout preventer (BOP) assembly 110, which may include shear rams 112, sealing rams 114, and/or an annular ram 116. One purpose of the BOP assembly 110 is to help control pressure in the wellbore 106. The BOP assembly 110 is connected to the vessel 102 by a riser 118. During drilling operations, a drill string 120 passes from a rig 122 on the vessel 102, through the riser 118, through the BOP assembly 110, through the wellhead housing 108, and into the wellbore 106. It should be appreciated that reference to the vessel 102 is for illustrative purposes only and that the vessel may be replaced with a floating/fixed platform or other structure. The lower end of the drill string 120 is attached to a drill bit 124 that extends the wellbore 106 as the drill string 120 turns. Additional features shown in FIG. 1 include a mud pump 126 with mud lines 128 connecting the mud pump 126 to the BOP assembly 110, and a mud return line 130 connecting the mud pump 126 to the vessel 102. A remotely operated vehicle (ROV) 132 can be used to make adjustments to, repair, or replace equipment as necessary. Although a BOP assembly 110 is shown in the figures, the wellhead housing 104 could be attached to other well equipment as well, including, for example, a tree, a spool, a manifold, or another valve or completion assembly.

One efficient way to start drilling a wellbore 106 is through use of a suction pile 134. Such a procedure is accomplished by attaching the wellhead housing 108 to the top of the suction pile 134 and lowering the suction pile 134 to a sea floor 136. As interior chambers in the suction pile 134 are evacuated, the suction pile 134 is driven into the sea floor 136, as shown in FIG. 1, until the suction pile 134 is substantially submerged in the sea floor 136 and the wellhead housing 108 is positioned at the sea floor 136 so that further drilling can commence. As the wellbore 106 is drilled, the walls of the wellbore are reinforced with concrete casings 138 that provide stability to the wellbore 106 and help to control pressure from the formation. It should be appreciated that this describes one example of a portion of a subsea drilling operation and may be omitted in various embodiments. In at least one embodiment, systems and methods of the present disclosure may be used for drilling operations that are completed through a BOP and wellhead, where a casing hanger and string are landed in succession. As noted above, configurations with respect to a sea floor or any offshore application are for illustrative purposes and embodiments of the present disclosure may also be utilized in surface drilling applications.

Figure 1B:
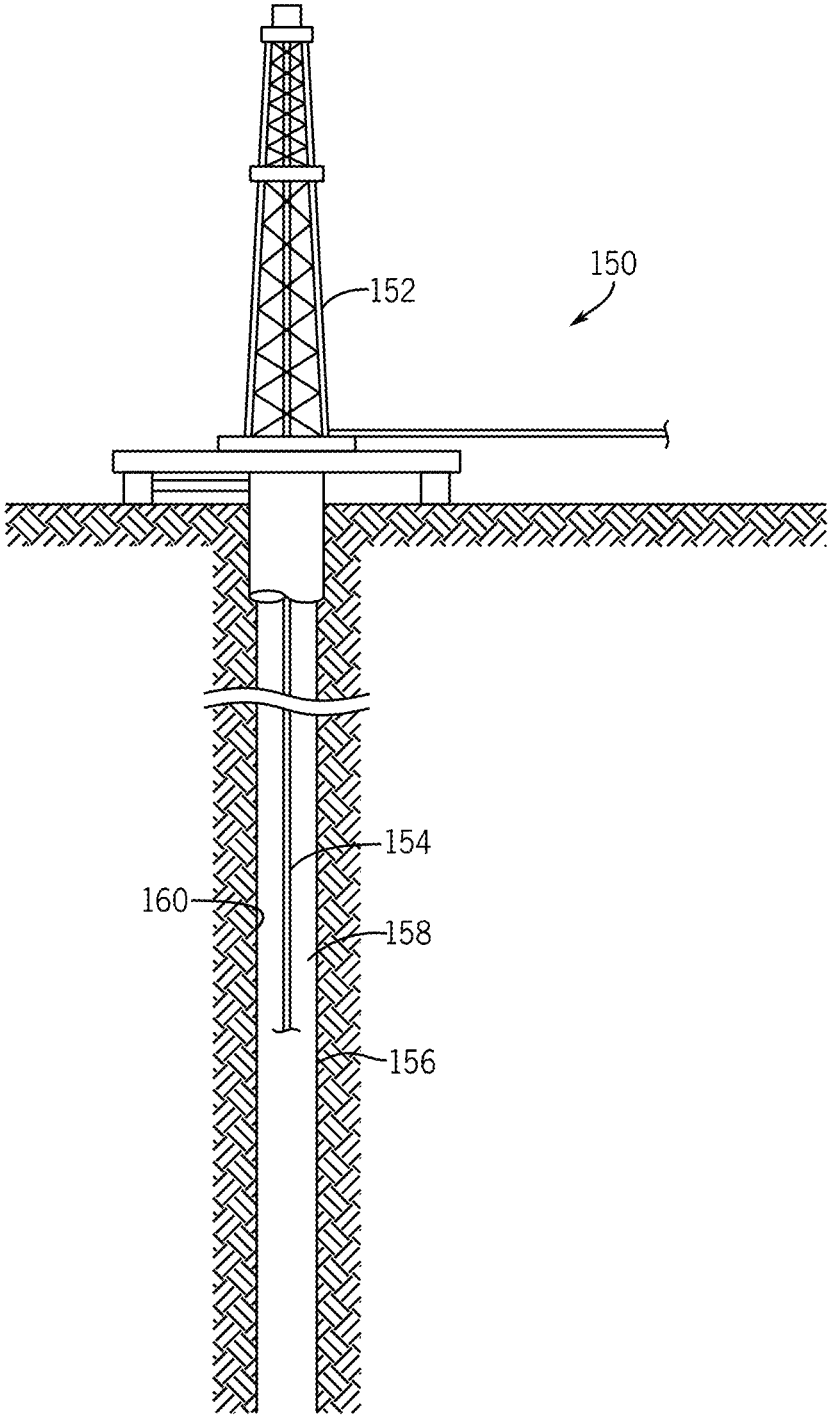
FIG. 1B is a cross-sectional side view of an embodiment of a wellbore system, in accordance with embodiments of the present disclosure.

FIG. 1B is a schematic side view of an embodiment of a wellbore system 150, which may include a completion system, a recovery system, or a drilling system. In this example, the wellbore system 150 a rig 152 and a string 154 coupled to the rig 152. The string 154 may extend through a wellhead assembly (not pictured) such as a blowout preventer (BOP) and/or one or more valve configurations. The wellhead assembly may be a surface assembly, which is not visible in the illustrated embodiment due to a platform of the rig 152, but it should be appreciated that it may be provided in various embodiments. Systems and methods may be utilized in embodiments where one or more completion or recovery operations are initiated, such as when the string 154 is suspended into a wellbore 156. In this example, the string 154 may be a completion or production string, which may include one or more tubulars coupled together and suspended from one or more features, such as the wellhead assembly and/or a casing/tubing hanger, among other options. It should be appreciated that the string 154 may also be a casing string, where one or more cementing operations may be used to cement and secure the string 154 to a wellbore wall. Furthermore, various embodiments may also implement such configurations during drilling operations, where the string 154 includes a drill bit at an end.

In this example, the string 154 is suspended into an annulus 158 formed between the string 154 and a wellbore wall 160. The string 154, as noted above, may be secured to one or more assembly that are configured to receive and support the string 154, such as a hanger assembly. In operation, the hanger assembly may be arranged within the wellbore 156, or at a surface location, and may include one or more seals to control pressure within the wellbore. Embodiments of the present disclosure may be incorporated with one or more of exploration, drilling, completion, and/or recovery efforts associated with subsea and/or surface applications. Furthermore, embodiments may also be used with various intervention or injection operations, among other uses for wellbores.

Various embodiments of the present disclosure incorporate one or more sealing systems that may be incorporated into different sealing configurations between various components, such as between a tubular and a hanger, between different sections of tubular piping, between a wellhead and a BOP, and/or the like. Embodiments may include a sealing system that includes an asymmetric cross-section sealing configuration with respect to a top seal portion (e.g., a first leg) and a bottom seal portion (e.g., a second leg). As discussed herein, the asymmetric cross-sectional configuration may provide a sealing arrangement such that the top seal portion may seal along a first diameter at a first contact point (e.g., first seal band, a first radial contact, etc.) and the bottom seal portion may seal along a second diameter at a second contact point (e.g., second seal band, a second radial contact, etc.). Systems and methods may be used to enable coupling and use of one or more modified tubular configurations that include different sized bores to accommodate one or more features.

Figure 2:
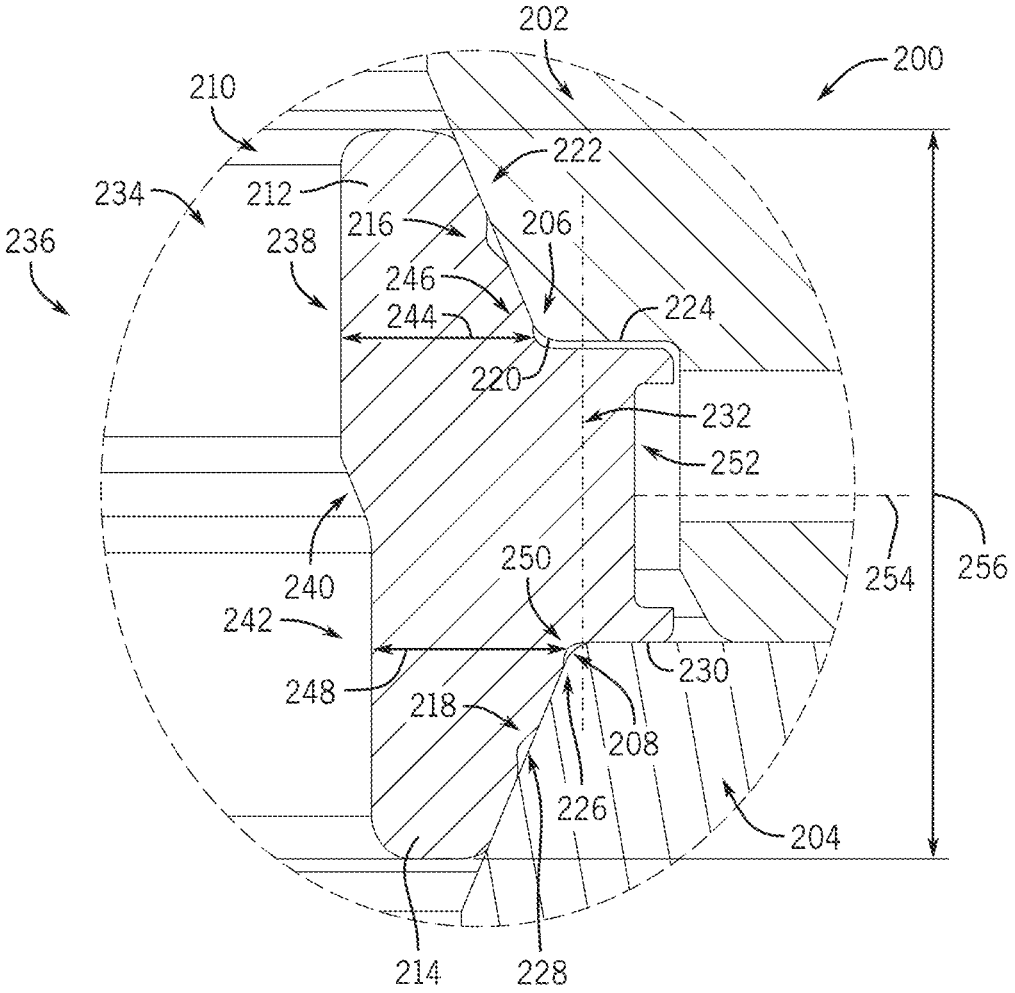
FIG. 2 is a sectional view of an embodiment of a connection between two components including a seal, in accordance with embodiments of the present disclosure.

FIG. 2 is a sectional view of an embodiment of a connection 200 including a first component 202 and a second component 204. In this example, the first component 202 may correspond to a tree or other wellbore connector and the second component 204 may correspond to a wellhead. It should be appreciated that these particular components are referenced by way of non-limiting example for clarity with the present discussion and are not intended to limit or otherwise restrict the scope of the present disclosure. As discussed herein, the different components 202, 204 may be coupled together via one or more fasteners, such as threaded fasteners, that axially align the components 202, 204 and draw the components 202, 204 together as the fasteners are tightened. In various embodiments, the components 202, 204 may be used to form a barrier for both internal pressure and external pressure with respect to an interior of the components 202, 204, such as for fluid (e.g., gas, liquid, solid, combinations thereof) flowing through the components 202, 204. As discussed herein, to facilitate formation of a sealed environment, the components 202, 204 may be coupled together with one or more sealing systems at an interface between the components 202, 204.

The illustrated configuration may include variable diameters between the first component 202 and the second component 204. In at least one embodiment, the first component 202 may include a new or updated system that is coupled to an existing system associated with the second component 204, and therefore, may include one or more alternative dimensions to accommodate new features. Various features of the present disclosure may be discussed with respect to diameters, but as shown, FIG. 2 illustrates a sectional view. However, one or more components shown herein may be annular components. Accordingly, the diameters may refer to the cross-sectional span of the component and/or, if a radius or radial distance is discussed, it should be appreciated that the diameter may be twice a radial space. In this example, a first inner diameter 206 of the first component 202 may be smaller than a second inner diameter 208 of the second component 204. In one non-limiting example, the first inner diameter 206 may be approximately 13-⅝ inches and the second inner diameter 208 may be approximately 14 inches. The configuration shown in FIG. 2 indicates the diameters 206, 208 at a transition between respective sloped profiles and respective flats, but as shown, the diameters 206, 208 may be variable over a span based on the sloped profiles. However, for purposes of the discussion herein, the diameters 206, 208 may be discussed with reference to "largest" dimensions or otherwise locations at transitions to the flats. That is, for each component, the diameters may change along the sloped sealing profiles, where the diameter is largest at the interface between the components and then smaller as the sloped profile is sloped inwardly toward an axis of the component. The diameters 206, 208 may further correspond to diameters associated with a seal 210 positioned between the first component 202 and the second component 204. The seal 210 may be a metal seal that, when compressed between the first component 202 and the second component 204, forms two metal-to-metal contacts. For example, a first metal-to-metal contact may be formed between a first seal portion and the first component 202 and a second metal-to-metal contact may be formed between a second seal portion and the second component 204.

In this example, the illustrated seal 210 includes a first leg 212 (e.g., first seal portion, upper portion, upper leg, uphole portion, uphole leg, etc.) and a second leg 214 (e.g., second seal portion, lower portion, lower leg, downhole portion, downhole leg, etc.), with the first leg 212 shown on an uphole side associated with the first component 202 and the second leg 214 shown on a downhole side associated with the second component 204. The illustrated seal 210 includes respective sealing profiles 216, 218 for the first leg 212 and the second leg 214. In at least one embodiment, the sealing profiles 216, 218 may be substantially similar and/or equal. For example, angles of the seal profile 216, 218 may be the same, lengths of the sealing profile 216, 218 may be the same (e.g., a length from a top of the sealing profile to a transition may be equal for both sealing profiles 216, 218), features (e.g., bumps, gaps, etc.) may the same, and/or the like. However, in at least one embodiment, one or more elements of the sealing profile 216, 218 may be different, such as having different angles, different lengths, different features, and/or combinations thereof.

In at least one embodiment, the seal 210 may be referred to as a seal with an asymmetric cross-section (e.g., an asymmetric seal) due to one or more contact locations where the seal 210 engages one of the first component 202 and the second component 204. In other words, the asymmetric cross-section is used to fit mismatched seal groove sizes. For example, a first transition 220, corresponding to the first diameter 206, is present between a first mating seal interface 222 and a first flat 224 of the first component 202. Similarly, a second transition 226, corresponding to the second diameter 208, is present between a second mating seal interface 228 and a second flat 230 of the second component 204. As depicted by the dashed line 232, the first and second transitions 220, 226 are not aligned. In other words, the second transition 226 is radially farther outward than the first transition 220 with respect to an axis of the wellbore. Accordingly, the locations of one or more seal bands (e.g., contact areas) forming sealing engagement between the seal 210 and the components 202, 204 may be different. Accordingly, systems and methods provide for an asymmetric sealing configuration due to the different sealing diameters associated with the first component 202 and the second component 204. As discussed herein, the asymmetric component may facilitate engagement between components that have variable diameters to accommodate for different mating components while still providing sufficient sealing engagement for a variety of wellbore operations.

In this example, line contacts (e.g., seal bands) are formed circumferentially around the seal 210 when pressure is applied to engage the first and second sealing interfaces 222, 226 with the sealing profile 216, 218. As discussed herein, the entire sealing profiles 216, 218 may not engage the entire sealing interfaces 222, 226, respectively, but one or more features or elements, such as bumps or the like, may be used to particularly enable certain locations for the line contacts. However, for clarity, the line contact may be described to discuss engagement and operation of the seal 210. In operation, pressure may be present within the first and second components 202, 204, thereby applying a force against the first and second legs 212, 214, driving the first and second legs 212, 214 into the first and second components 202, 204, respectively, and improving and enhancing the sealing contact of the seal. Additionally, in at least one embodiment, the seal 210 is also used to prevent and block external forces from entering the interior area formed by the first and second components 202, 204. In at least one embodiment, pressures of approximately 10,000 psi to 15,000 psi may be associated with one or more embodiments, but higher or lower pressures may also be used with embodiments of the present disclosure.

Systems and methods of the present disclosure may further incorporate a stepped bore 234 at an inner diameter 236 of the seal 210. As discussed herein, the inner diameter 236 may include multiple different diameter portions. In at least one embodiment, the stepped bore 234 may be configured to provide improved flexibility to the seal 210 to counteract the imbalance in structure from the asymmetric configuration. In this example, the stepped bore 234 includes a first diameter 238, a step 240 with a variable diameter, and a second diameter 242. It should be appreciated that there may be additional steps 240 and multiple other changes in diameter and the single step 240 of FIG. 2 is provided by way of non-limiting example. Furthermore, the first and second diameters 238, 242 may also include variable diameters and may not be substantially linear or constant. Accordingly, the inclusion of the stepped bore 234 enables a "thinner" second leg 214 compared to a configuration in which the entire inner diameter 236 was equal to the first diameter 238, providing for more flexibility and a lower setting pressure.

Systems and methods of the present disclose provide the seal 210 having both the asymmetric cross-section and a variable leg thickness to enable sealing configurations between components with variable sealing diameters. In this example, the first leg 212 includes a variable thickness (e.g., is thicker at a top than the bottom due to the sloped sealing profile 216), but for this example, a first leg thickness 244 may refer to a radial distance between the first diameter 238 and a first sealing profile end 246. In at least one embodiment, the thickness of the legs may be directly related to an amount of flexibility associated with the legs and/or a setting pressure for the legs. For example, a thicker leg may have less flexibility, thereby needing a larger setting pressure. In certain embodiments, reducing the setting pressure may be desirable because smaller tools and/or less pressure may be used, which may increase costs and/or increase flexibility.

Similarly, the second leg 214 includes a variable thickness, but for this example, a second leg thickness 248 may refer to a radial distance between the second diameter 242 and a second sealing profile end 250. As shown, because of the different contact locations (represented by the dashed line 232), the second leg thickness 248 may greater than, equal to, or less than the first leg thickness 244 in various embodiments. In at least one embodiment, the thicknesses 244, 248 may be particularly selected based on desired operating conditions. For example, it may be desirable to have equal thicknesses 244, 248 so that a setting pressure may be substantially equal. In other embodiments, it may be desirable to have one thickness 244, 248 greater than the other.

In this configuration, the second leg thickness 248 is less than it otherwise would be for a scenario in which the step 240 were eliminated and the inner diameter 236 had a consistent first diameter 238. In other words, if the second diameter 242 where equal to the first diameter 238, then the second leg thickness 248 would be larger than shown in the embodiment of FIG. 2. Such a configuration would likely cause a thicker, less flexible second leg 214, which would likely use a higher set pressure to initially form a seal and could provide a less effective seal. Accordingly, systems and methods identify and address this problem by incorporating the step 240 to change the diameter to the second diameter 242, thereby providing flexibility to counteract the imbalance of the seal structure. That is, because the second diameter 208 is larger than the first diameter 206, if both the first and second legs 212, 214 began from the same point of reference (e.g., a common inner diameter), the legs 212, 214 would have inconsistent thicknesses that could create challenges with forming the seal, setting the seal, and/or maintaining the seal.

As shown in FIG. 2, the seal 210 further includes a rib 252 that extends radially outward. The rib 252 may also be referred to as portion of a seal body and is arranged at transitions at the respective sealing profile ends 246, 250. The step 240 in this example may be substantially centered with respect to the rib 252. That is, the step 240 may be aligned along a cross-axis 254 of the seal 210. However, it should be appreciated that the step 240 may be higher or lower than the cross-axis 254 and may be arranged at a variety of locations along a length 256 of the seal 210.

Figure 3:
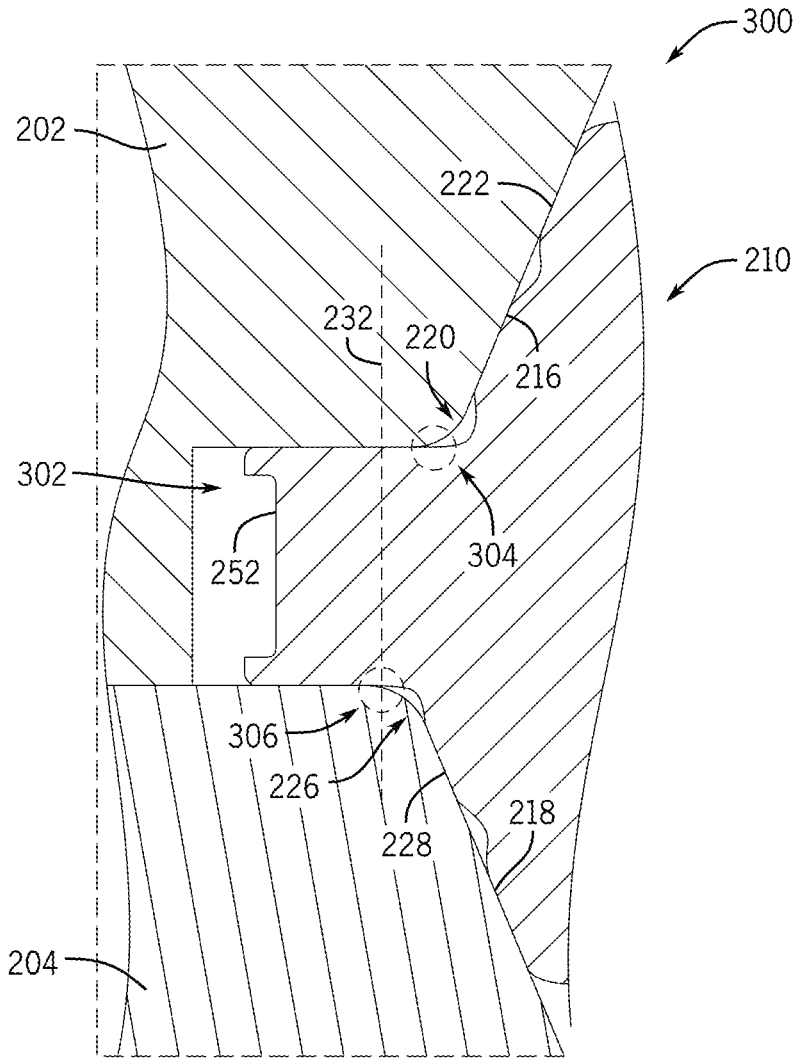
FIG. 3 is a cross-sectional view of an embodiment of a connection between two components including a seal, in accordance with embodiments of the present disclosure.

FIG. 3 illustrates a cross-sectional side view of an environment 300 that may be used with embodiments of the present disclosure. This configuration further illustrates the seal 210 arranged between the first component 202 and the second component 204 such that the rib 252 extends into a gap 302 between the first and second components 202, 204. As discussed herein, sealing contact may be formed between the first sealing profile 216 and the first sealing interface 222 and the second sealing profile 218 and the second sealing interface 228 as the components 202, 204 are drawn together and/or as pressure acts on the inner diameter 236 of the seal 210. In this example, the asymmetric cross-section is further visible at illustrated contact points 304, 306 (e.g., a first radial contact point, a second radial contact point, etc.), which are represented by dashed circles as non-limiting examples and for reference only. As shown, the different diameters 206, 208 cause the asymmetric contacts with respect to the first leg 212 and the second leg 214 because the sealing diameters are different.

In at least one embodiment, the asymmetry of the configuration may be described with respect to the transitions 220, 226 and/or as represented by the dashed line 232. In this example, the second transition 226 is radially farther outward (e.g., closer to the gap 302) than the first transition 220. As noted, the larger diameter of the second component 204 causes this configuration, which may cause problems with sealing with traditional configurations. Systems and methods of the present disclosure address and overcome these problems by incorporating the asymmetric seal 210 that includes the sealing profile configurations that facilitate different positions for respective sealing interfaces. Furthermore, in at least one embodiment, a stepped profile along the inner diameter may be used to adjust or control a leg size so that setting pressures and flexibility may be tuned for different operating configurations.

Figure 4:
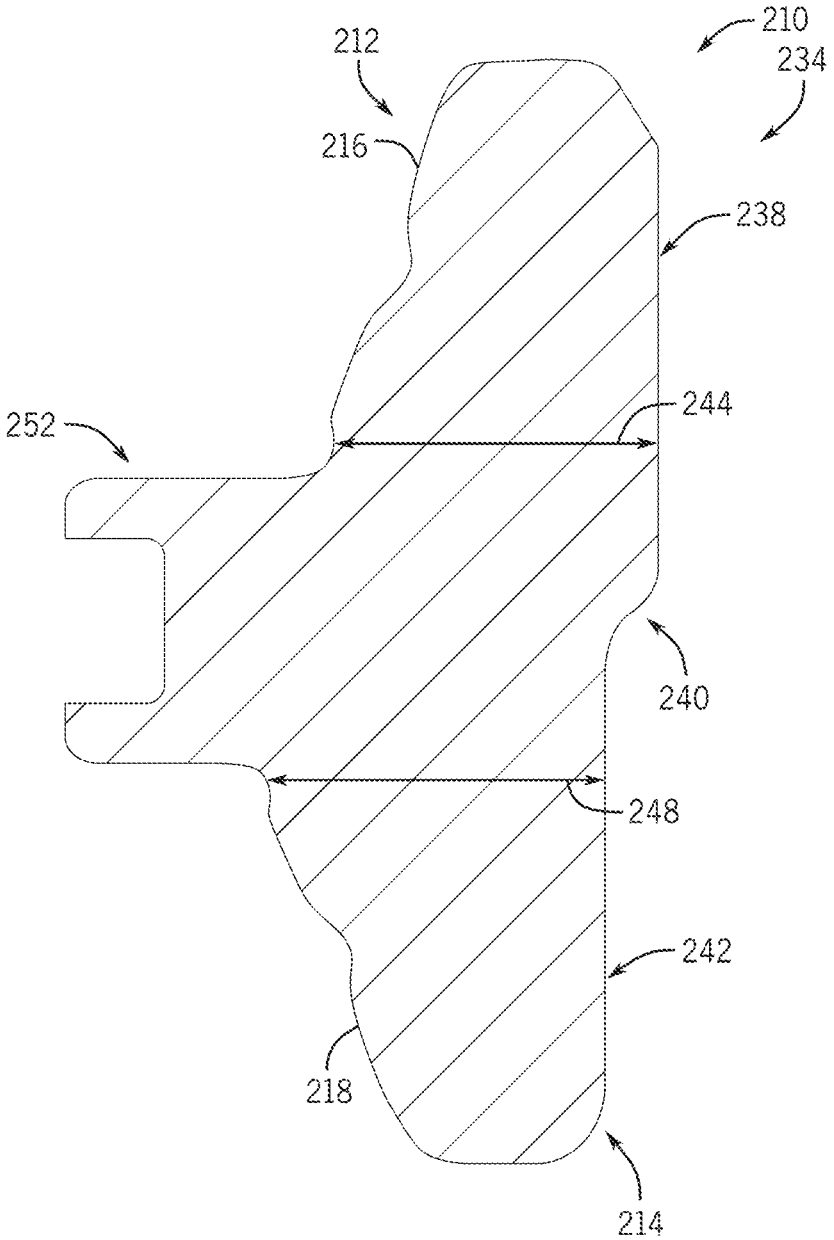
FIG. 4 is a cross-sectional view of an embodiment of a seal including an asymmetric cross-sectional, in accordance with embodiments of the present disclosure.

FIG. 4 illustrates a cross-sectional view of an embodiment of the seal 210 that may be used with embodiments of the present disclosure. This example seal 210 includes the first and second legs 212, 214 having the respective sealing profiles 216, 218. While this example includes bumps or recesses along the profiles 216, 218, it should be appreciated that other configurations may include more or fewer bumps/recesses or may omit the bumps/recesses.

The configuration further illustrates the stepped bore 234 along the inner diameter, including the first diameter 238, the step 240, and the second diameter 242. As discussed herein, the inclusion of a single step 240 is by way of non-limiting example and there may be more or fewer steps. For example, instead of a step, a smooth transition or slope between the first diameter 238 and the second diameter 242 may be included. In at least one embodiment, the first diameter 238 may substantially correspond to and/or align with the first leg 212 and the second diameter 242 may substantially correspond to and/or align with the second leg 214. The rib 252 may be aligned to include at least a portion of the first or second diameters 238, 242 in various embodiments.

The difference in the diameters may correspond to a difference in and/or modifications to respective thicknesses 244, 248 for the first and second legs 212, 214. For example, because the second leg 214 may be associated with sealing against a larger diameter, reducing the second diameter 242, compared to the first diameter 238, may provide additional flexibility for the second leg 214, which would not be present if the seal maintained a constant inner diameter. Accordingly, systems and methods account for the different sealing interfaces may modifying the inner diameter of the seal 210 to provide a desired level or flexibility for each of the first and second legs 212, 214.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A wellbore system, comprising:

a first component having a first sealing interface at a first diameter;

a second component having a second sealing interface at a second diameter, the second diameter being larger than the first diameter; and a seal arranged between the first component and the second component, comprising:

a first leg having a slanted first sealing profile configured to engage the first sealing interface, the slanted first sealing profile extending for a first length;

a second leg having a slanted second sealing profile configured to engage the second sealing interface, the slanted second sealing profile extending for a second length; and a stepped inner diameter including a first inner diameter associated with the first leg, a second inner diameter associated with the second leg, and a step between the first inner diameter and the second inner diameter, wherein the first inner diameter is a first linear inner diameter extending along at least a portion of the first length and the second inner diameter is a second linear inner diameter extending along at least a portion of the second length;

wherein the seal includes an asymmetric cross-section corresponding to different radial contact points between the first leg and the first component and the second leg and the second component, wherein a first radial contact point, of the different radial contact points, is positioned at a first transition for the first component between a first planar portion of the first component and the first sealing interface, and a second radial contact point, of the different radial contact points, is positioned at a second transition for the second component between a second planar portion of the second component and the second sealing interface.

2. The wellbore system of claim 1, wherein the slanted first sealing profile and the slanted second sealing profile have a common angle.

3. The wellbore system of claim 1, wherein the first inner diameter is less than the second inner diameter.

4. The wellbore system of claim 1, wherein a first thickness of the first leg is less than or equal to a second thickness of the second leg.

5. The wellbore system of claim 1, wherein a first thickness of the first leg is greater than or equal to a second thickness of the second leg.

6. The wellbore system of claim 1, wherein the seal further comprises:

a rib between the first leg and the second leg, wherein the step is centered along a length of the rib.

7. The wellbore system of claim 1, wherein the seal is metallic, the first component is metallic, and the second component is metallic such that engagement of the seal forms at least two metal-to-metal sealing interfaces.

8. The wellbore system of claim 7, wherein the first sealing profile extends to a first radial seal position, the second sealing profile extends to a second radial seal position, and a first distance between the first radial seal position and the first inner diameter is less than a second distance between the second radial seal position and the first inner diameter.

9. The wellbore system of claim 1, wherein at least one of the first inner diameter or the second inner diameter is particularly selected based on a target flexibility of the second leg.

10. A metallic seal, comprising:

a rib;

a first leg, coupled to the rib, having a first sealing profile;

a second leg, coupled to the rib, having a second sealing profile;

an inner bore including a first inner diameter extending for a first length in a linear orientation, a second inner diameter extending for a second length in the linear orientation, and a step between the first inner diameter and the second inner diameter;

a first radial contact point, aligned with the first inner diameter, at a first radial distance from a rib end, the first radial contact point arranged along a first transition between the rib and the first sealing profile; and a second radial contact point, aligned with the second inner diameter, at a second radial distance from the rib end, the second radial contact point arranged along a second transition between the rib and the second sealing profile, wherein the first radial distance is greater than the second radial distance.

11. The metallic seal of claim 10, wherein at least one of the first sealing profile or the second sealing profile includes at least one of a bump or a groove.

12. The metallic seal of claim 10, wherein a first angle of the first sealing profile equals a second angle of the second sealing profile.

13. The metallic seal of claim 10, wherein the first inner diameter is less than the second inner diameter.

14. The metallic seal of claim 10, wherein the step includes a sloped surface.

15. The metallic seal of claim 10, wherein a first leg thickness, corresponding to a first radial distance between the first radial contact point and the first inner diameter, is greater than or equal to a second leg thickness, corresponding to a second radial distance between the second radial contact point and the second inner diameter.

16. The metallic seal of claim 10, wherein a first leg thickness, corresponding to a first radial distance between the first radial contact point and the first inner diameter, is less than or equal to a second leg thickness, corresponding to a second radial distance between the second radial contact point and the second inner diameter.

17. A metallic seal, comprising:

a seal body;

a first leg having a first sealing profile;

a second leg having a second sealing profile, the first and second legs separated by at least a portion of the seal body;

an inner bore including a first inner diameter and a second inner diameter, each of the first inner diameter and the second inner diameter positioned in a linear orientation, wherein the first sealing profile is arranged at a first angle relative to the first inner diameter and the second sealing profile is positioned at a second angle relative to the second inner diameter;

a first radial contact point positioned along a first flat of the seal body at a first transition between the first flat and the first sealing profile; and a second radial contact point positioned along a second flat of the seal body at a second transition between the first flat and the second sealing profile, wherein the second radial contact point is at a larger outer diameter of the seal than the first radial contact point.

18. The metallic seal of claim 17, wherein at least one of the first sealing profile or the second sealing profile includes at least one of a bump or a groove.

19. The metallic seal of claim 17, wherein a first angle of the first sealing profile equals a second angle of the second sealing profile.

20. The metallic seal of claim 17, wherein the first inner diameter is less than the second inner diameter.

* * * * *